US005577648A

United States Patent [19]

Sason et al.

[11] Patent Number: 5,577,648

[45] Date of Patent: Nov. 26, 1996

[54] LOAD CARRIER

[75] Inventors: Dan Sason, Kochav Yair; Ziv Orovan, Hinanit, both of Israel

[73] Assignee: Modan Industries (1983) Ltd., Tel Aviv, Israel

[21] Appl. No.: 987,016

[22] Filed: Dec. 7, 1992

[30] Foreign Application Priority Data

| | | | |
|---|---|---|---|
| Dec. 13, 1991 | [IL] | Israel | 100374 |
| Aug. 13, 1992 | [IL] | Israel | 102800 |
| Aug. 21, 1992 | [IL] | Israel | 102903 |

[51] Int. Cl.[6] ..... A45F 3/04

[52] U.S. Cl. ..... 224/637; 224/264; 224/643; 224/644

[58] Field of Search ..... 224/215, 202, 224/264, 208, 209, 203, 204, 205, 206, 207; 2/267, 268, 311, 310

[56] References Cited

U.S. PATENT DOCUMENTS

| | | | |
|---|---|---|---|
| 3,882,914 | 5/1975 | Strutz | 224/264 |
| 4,179,826 | 12/1979 | Davidson | 36/71 X |
| 4,401,246 | 8/1983 | Dickinson et al. | 224/264 |
| 4,420,103 | 12/1983 | Douglass | 224/210 |
| 4,739,913 | 4/1988 | Moore | 224/215 |
| 4,744,601 | 5/1988 | Nakanishi | 5/909 |
| 4,750,654 | 6/1988 | Menetrier . | |
| 4,815,361 | 3/1989 | Chiarella | 5/909 X |
| 4,884,731 | 12/1989 | Sibley | 224/215 |
| 5,191,752 | 3/1993 | Murphy | 54/44.5 |
| 5,292,044 | 3/1994 | Reimers | 224/264 |

FOREIGN PATENT DOCUMENTS

| | | | |
|---|---|---|---|
| 2313886 | 1/1977 | France . | |
| 2387002 | 11/1978 | France . | |
| 2406402 | 6/1979 | France | 224/264 |
| 8816653 | 2/1990 | Germany . | |

OTHER PUBLICATIONS

Patent Abstracts of Japan, vol. 014, No. 299 (C–0733) 27 Jun. 1990 & JP–A–02 099 054 (Nakamura) 11 Apr. 1990.

Catalog: Millet, S. A., B. P. 109 74600, Annecy–Seynod, France, p. 15. (no date).

*Primary Examiner*—David J. Walczak

*Attorney, Agent, or Firm*—Ladas & Parry

[57] ABSTRACT

A backpack including a body engaging strap assembly and a strap assembly supported element supported on the body engaging strap assembly and including a container and an integrally formed back engaging portion having a padded back facing surface and a generally rigid curved opposite surface fixed thereto, the integrally formed back engaging portion defining a first generally vertically extending curve arranged to be centered adjacent the upper back portion of a user and a second generally horizontally extending curve arranged to be centered adjacent the lower back portion, the integrally formed back engaging portion being bendable about a horizontal axis located adjacent the center of the first curve and about a vertical axis located adjacent the center of the second curve.

4 Claims, 8 Drawing Sheets

FIG.6
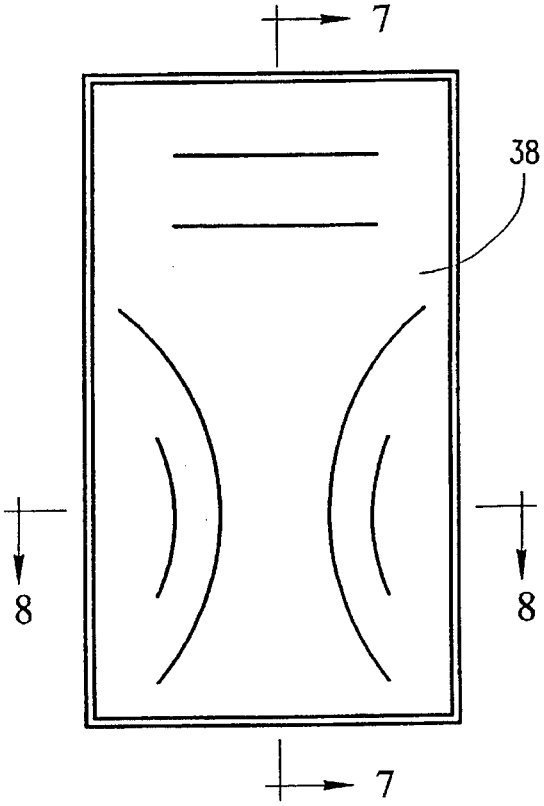
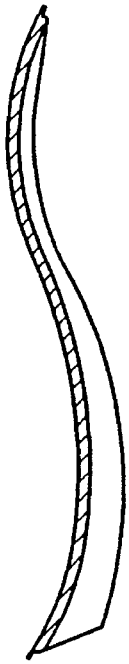
FIG.7
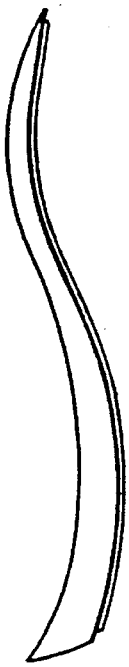
FIG.9
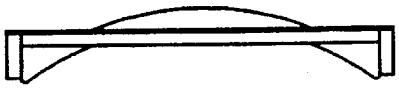
FIG.10
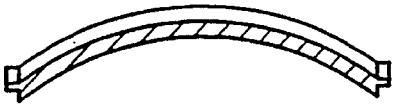
FIG.8
FIG.5
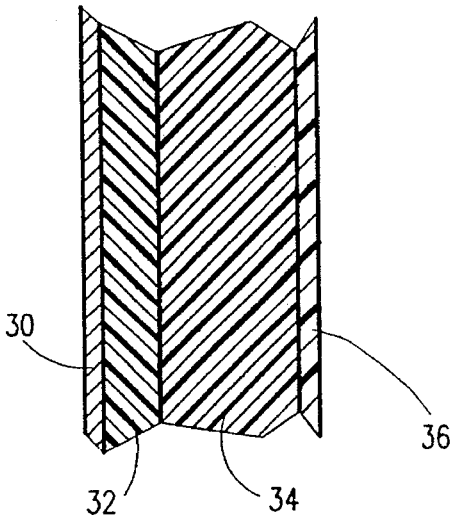

FIG.11
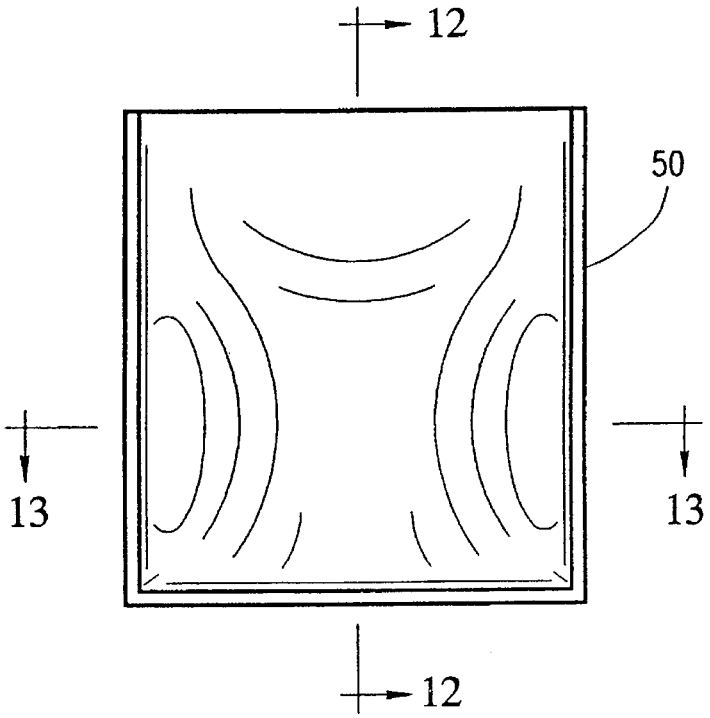
FIG.14
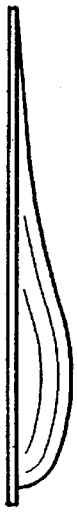
FIG.12
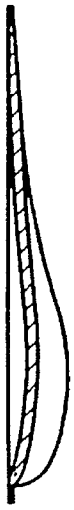
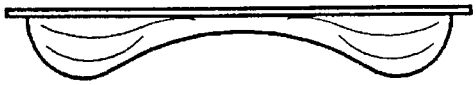
FIG.15
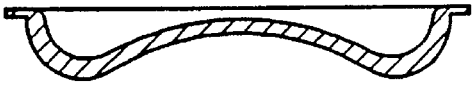
FIG.13

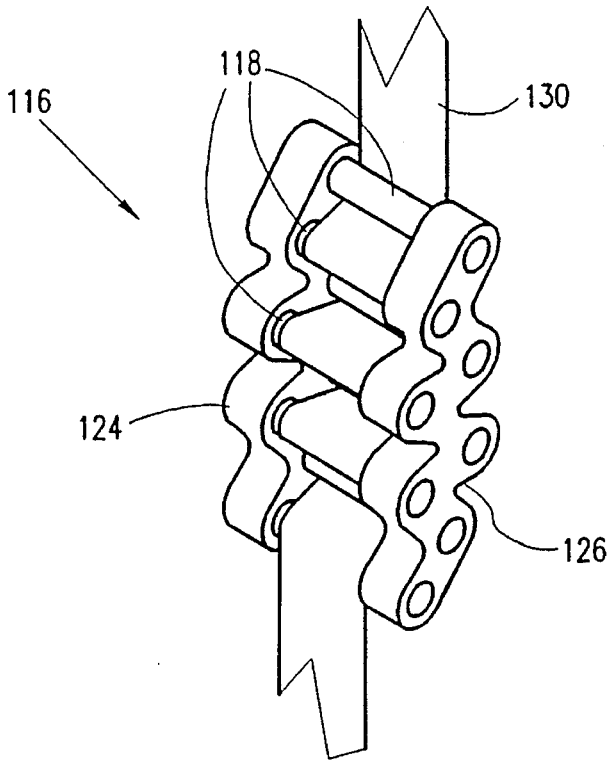
FIG.17
FIG.18A
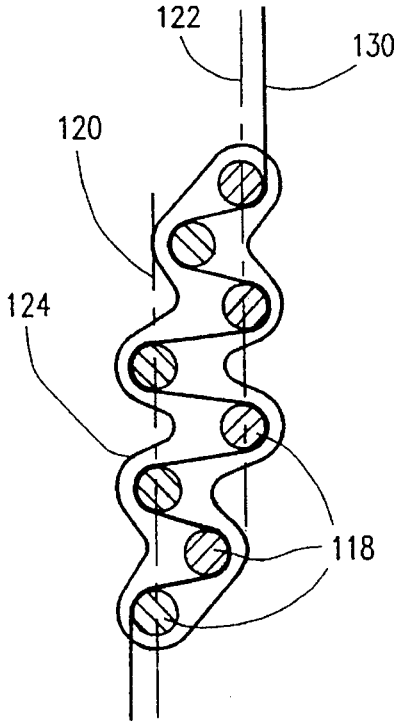
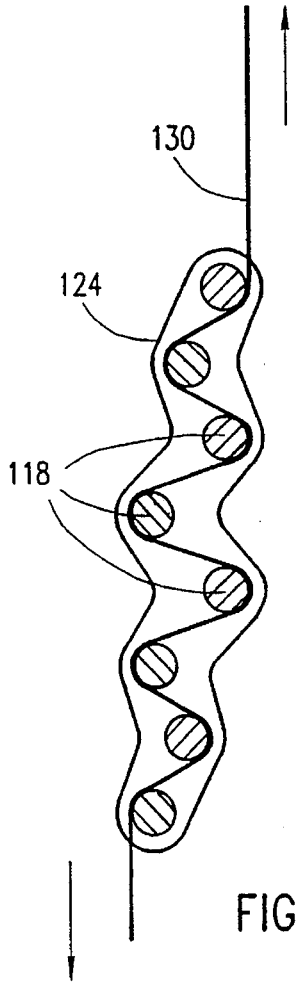
FIG.18B

LOAD CARRIER

FIELD OF THE INVENTION

The present invention relates to backpacks, back mounted load supports and resilient mounting apparatus generally and more particularly to resilient mounting apparatus for use with a strap.

BACKGROUND OF THE INVENTION

A great variety of resilient mounting devices such as backpacks and shoulder harnesses are known and extend from children's schoolbags to child-toting packs to professionally designed mountaineer's packs. When used in long duration, difficult activities and under heavy loads, the shoulder straps of such packs and harnesses tend to rub and scrape against the user's shoulders, thus causing discomfort to the user.

Resilient mounting devices which absorb forces, impacts and displacements transmitted along a strap are known.

Whereas in the prior art, backpacks were conventionally constructed to have a generally flat back-engaging surface, recently backpacks have been designed with non-flat surfaces. Applicants have proposed backpacks with curved back engaging surfaces including curves in multiple directions.

In the prior art, it is conventional to employ a curved rigid backing member which may be slipped into a suitable pocket defined at the back of the backpack. A catalog produced by Millet S. A., B.P. 109 74600 Annecy-Seynod, France, illustrates on page 15 an "anatomical" three dimensional backing with a vertical S shape.

SUMMARY OF THE INVENTION

The present invention seeks to provide an improved backpack.

There is thus provided in accordance with a preferred embodiment of the present invention a backpack including a body engaging strap assembly and a strap assembly supported element supported on the body engaging strap assembly and including a container and an integrally formed back engaging portion having a padded back facing surface and a generally rigid curved opposite surface fixed thereto, the integrally formed back engaging portion defining a first generally vertically extending curve arranged to be centered adjacent the upper back portion of a user and a second generally horizontally extending curve arranged to be centered adjacent the lower back portion, the integrally formed back engaging portion being bendable about a horizontal axis located adjacent the center of the first curve and about a vertical axis located adjacent the center of the second curve.

Additionally in accordance with a preferred embodiment of the present invention the integrally formed back engaging portion defines a curved peripheral edge which is joined to fabric defining the container.

According to an alternative embodiment of the invention, the integrally formed back engaging portion defines a peripheral edge which generally lies in a plane.

The present invention also seeks to provide an improved resilient mounting device.

There is thus provided in accordance with a further preferred embodiment of the present invention a resilient mounting device comprising a plurality of rods, and first and second resilient mounting elements associated with the plurality of rods at first and second ends thereof, whereby the mutual spacing of the plurality of rods may be varied.

In accordance with a preferred embodiment of the present invention a strap is threaded through the plurality of rods. The strap may be effectively lengthened by pulling the ends thereof apart, which causes the mutual spacing of the plurality of the rods to be increased against the resilient urging of the resilient mounting elements.

Additionally in accordance with a preferred embodiment of the present invention, the plurality of rods is arranged in at least two planes.

Further in accordance with a preferred embodiment of the present invention there is provided at least one resilient strap assembly including at least one resilient mounting device comprising a plurality of rods, first and second resilient mounting elements associated with the plurality of rods at first and second ends thereof, whereby the mutual spacing of the plurality of rods may be varied and a strap threaded through the plurality of rods whereby the strap may be effectively lengthened by pulling the ends thereof apart, which causes the mutual spacing of the plurality of the rods to be increased against the resilient urging of the resilient mounting elements.

Additionally in accordance with a preferred embodiment of the present invention there is provided a backpack comprising a shoulder harness, a load support and at least one resilient strap assembly interconnecting the shoulder harness and the load support, the at least one resilient strap assembly including at least one resilient mounting device comprising a plurality of rods, first and second resilient mounting elements associated with the plurality of rods at first and second ends thereof, whereby the mutual spacing of the plurality of rods may be varied and a strap threaded through the plurality of rods whereby the strap may be effectively lengthened by pulling the ends thereof apart, which causes the mutual spacing of the plurality of the rods to be increased against the resilient urging of the resilient mounting elements.

The present invention additionally seeks to provide an improved backpack and back mounted load support.

There is thus provided in accordance with another preferred embodiment of the present invention a back mounted load support including a load carrier and a body support including at least one of a shoulder strap assembly and a hip engaging belt assembly, wherein the body support is at least partially filled with a silicone gel.

In accordance with one embodiment of the present invention, the shoulder strap assembly includes shoulder straps, at least the shoulder engaging portion of which is filled with silicone gel. Alternatively, the entire shoulder strap may be filled with silicone gel.

Additionally in accordance with a preferred embodiment of the present invention, the hip engaging belt may be fully or partially filled with silicone gel.

It is appreciated that the present invention is not necessarily limited to silicone gel but equally applies to the use of a non-liquid material having similar characteristics which provide a similar feeling of softness to the user. Accordingly, in accordance with a preferred embodiment of the invention there is provided a back mounted load support including a load carrier and a body support including at least one of a shoulder strap assembly and a hip engaging belt assembly, wherein the body support is at least partially filled with a non-liquid material having the softness of silicone gel.

Further in accordance with a preferred embodiment of the present invention, the back engaging portion includes a fabric back engaging layer defining the back facing surface and bonded to at least one foam backing layer behind which is a rigid backing layer defining the generally rigid curved opposite surface.

Still further in accordance with a preferred embodiment of the present invention, the at least one foam backing layer comprises a first foam layer bonded to the fabric layer and a second foam layer, adjacent the rigid backing layer, which is denser than the first foam layer.

Still further in accordance with a preferred embodiment of the present invention, at least one resilient strap assembly is provided interconnecting the body engaging strap assembly and the strap assembly supported element, at least one resilient strap assembly including a plurality of rods and first and second resilient mounting elements associated with the plurality of rods at first and second ends thereof, whereby the mutual spacing of the plurality of rods may be varied, wherein a strap threaded through the plurality of rods may be effectively lengthened by pulling the ends thereof apart, which causes the mutual spacing of the plurality of the rods to be increased against the resilient urging of the resilient mounting elements.

Further in accordance with a preferred embodiment of the present invention, the body engaging strap assembly includes shoulder straps, at least the shoulder engaging portion of which is filled with silicone gel.

Still further in accordance with a preferred embodiment of the present invention, the shoulder harness includes shoulder straps, at least the shoulder engaging portion of which is filled with silicone gel.

BRIEF DESCRIPTION OF THE DRAWINGS

The present invention will be understood and appreciated more fully from the following detailed description, taken in conjunction with the drawings in which:

FIG. 5 is a sectional illustration of the integrally formed back engaging portion forming part of the backpack of FIGS. 1 and 2;

FIG. 6 is a planar illustration of the integrally formed back engaging portion forming part of the backpack of FIGS. 1 and 2;

FIG. 7 is a sectional illustration of the integrally formed back engaging portion forming part of the backpack of FIG. 6 taken along lines VII—VII;

FIG. 8 is a sectional illustration of the integrally formed back engaging portion forming part of the backpack of FIG. 6 taken along lines VIII—VIII;

FIGS. 9 and 10 are respective side and end view illustrations of the integrally formed back engaging portion forming part of the backpack of FIGS. 1 and 2;

FIG. 11 is a planar illustration of the integrally formed back engaging portion forming part of the backpack of FIGS. 3 and 4;

FIG. 12 is a sectional illustration of the integrally formed back engaging portion forming part of the backpack of FIG. 11 taken along lines XII—XII;

FIG. 13 is a sectional illustration of the integrally formed back engaging portion forming part of the backpack of FIG. 11 taken along lines XIII—XIII;

FIGS. 14 and 15 are respective side and end view illustrations of the integrally formed back engaging portion forming part of the backpack of FIGS. 3 and 4;

FIG. 17 is a pictorial illustration of a resilient strap assembly constructed and operative in accordance with a preferred embodiment of the present invention;

FIGS. 18A and 18B are sectional illustrations of the resilient strap assembly of FIG. 17 in respective at-rest and tensioned orientations;

DETAILED DESCRIPTION OF PREFERRED EMBODIMENTS

Figure 1:
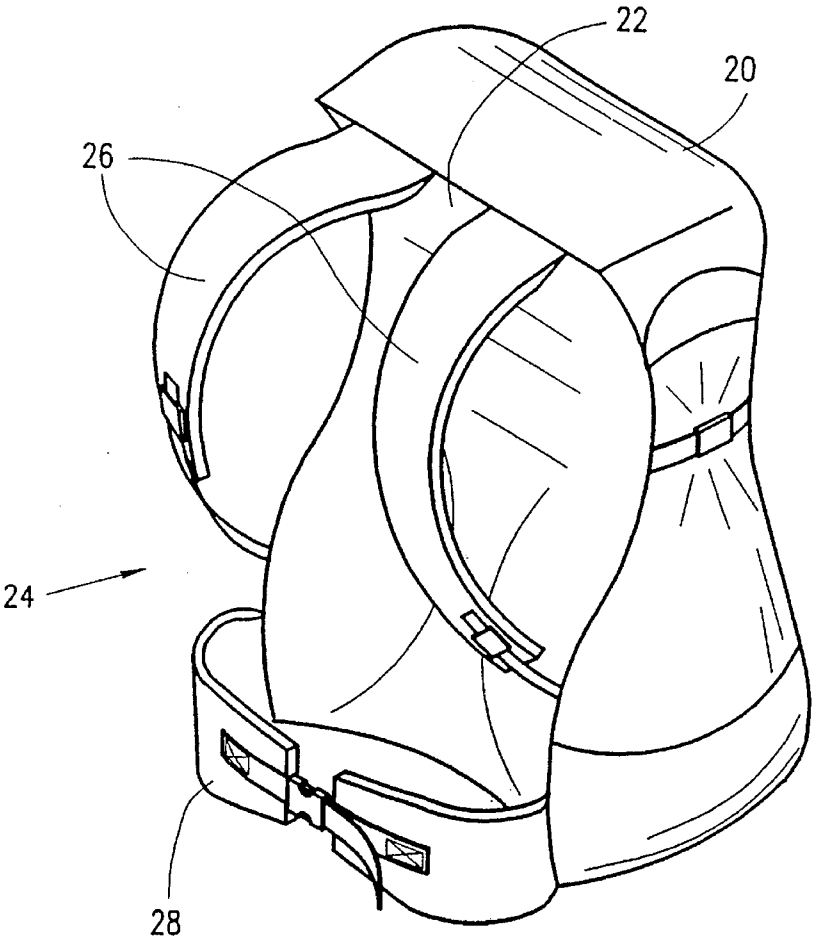
FIG. 1 is a pictorial illustration of a backpack constructed and operative in accordance with a preferred embodiment of the present invention.
Figure 2:
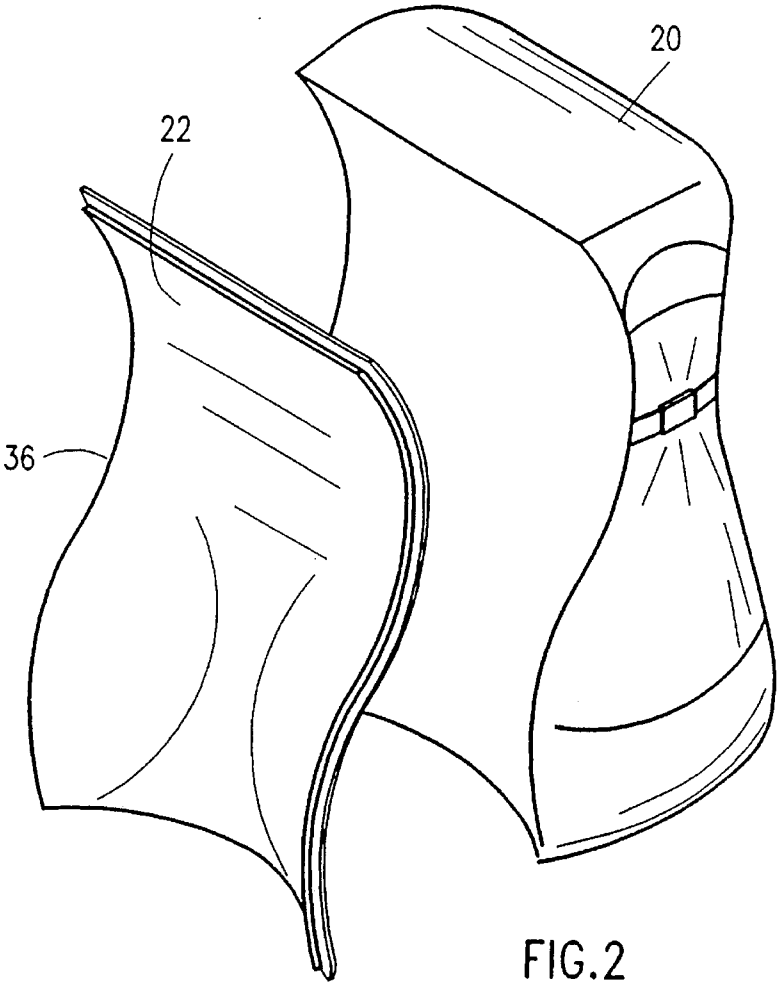
FIG. 2 is an exploded pictorial illustration of part of the backpack of FIG. 1.
Figure 3:
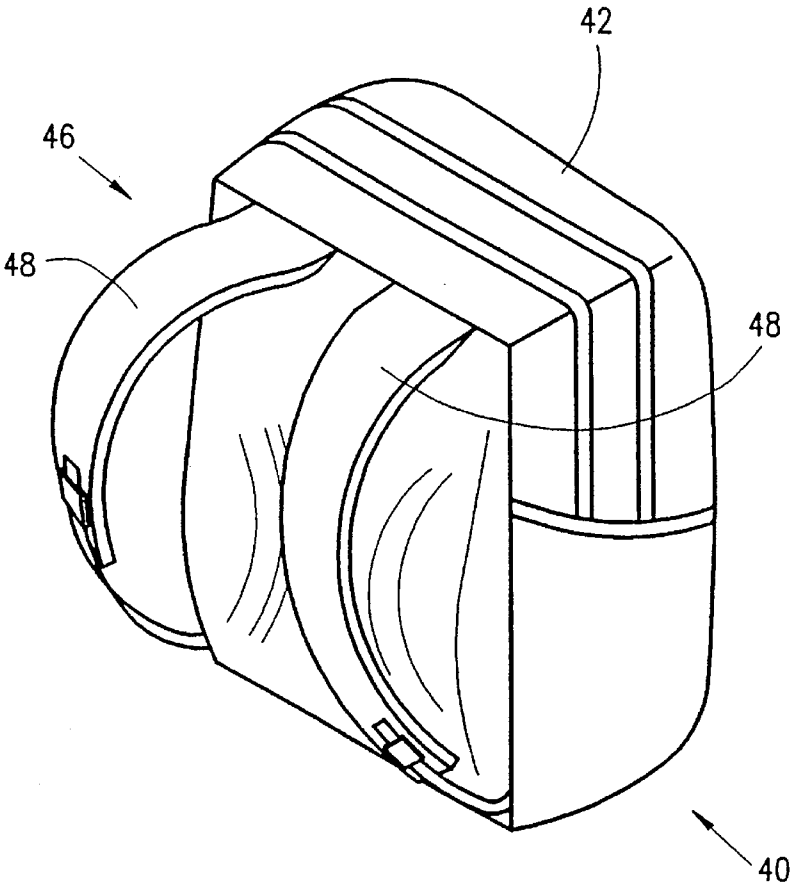
FIG. 3 is a pictorial illustration of a backpack constructed and operative in accordance with another preferred embodiment of the present invention.
Figure 4:
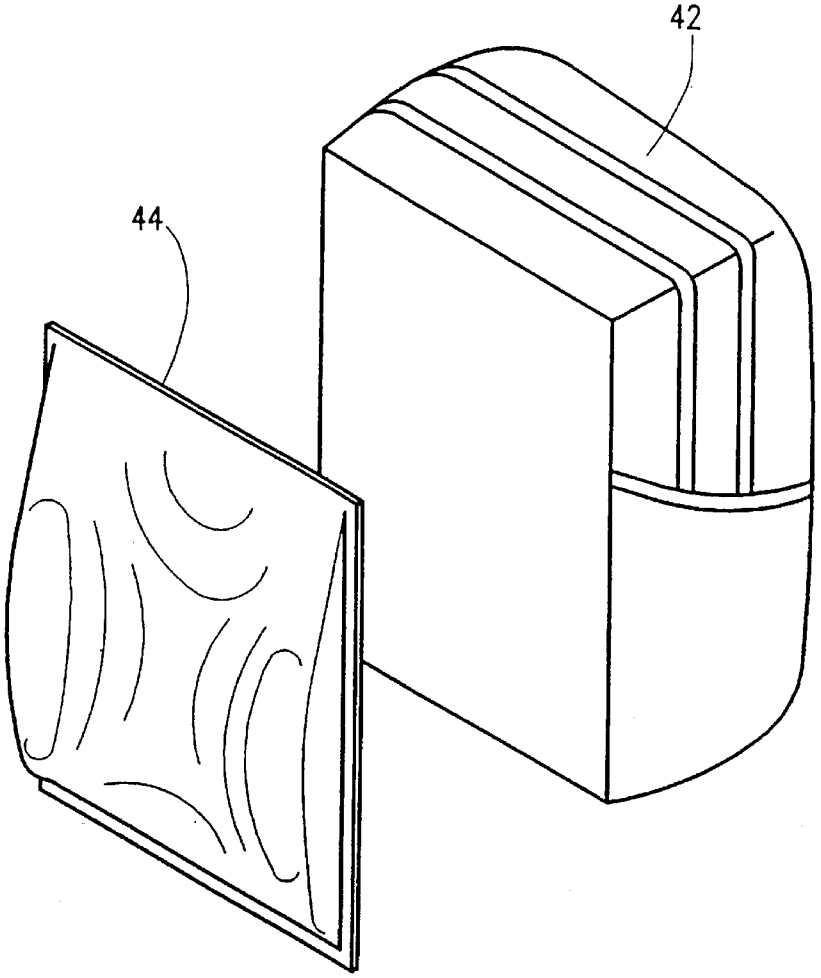
FIG. 4 is an exploded pictorial illustration of part of the backpack of FIG. 2.

Reference is now made to FIGS. 1, 2 and 5–10, which illustrate a backpack constructed and operative in accordance with a preferred embodiment of the present invention. The backpack comprises a container portion 20, typically formed of fabric and which may be of any suitable construction, which is mounted, as by sewing, onto an integrally formed curved back engaging portion 22, in accordance with a preferred embodiment of the present invention.

A body mounting strap assembly 24 supports the container portion 20 and the back engaging portion 22 and preferably comprises a pair of shoulder straps 26 and a waist strap 28, all of which may be of any suitable conventional construction.

In accordance with a preferred embodiment of the present invention, the integrally formed curved back engaging portion 22 is of multilayer construction, as seen particularly in FIG. 5, and includes a fabric back engaging surface 30, which is bonded to a first foam backing layer 32. Disposed behind first foam backing layer 32 is a second foam backing layer 34, which is typically more dense than layer 32. Behind layer 34 is a generally rigid plastic backing layer 36.

In accordance with a preferred embodiment of the invention the backing layer 36 is curved and imparts corresponding curvature to the entire integrally formed back engaging portion 22. The configuration of backing layer 36 and thus of back engaging portion 22 defines a first generally vertically extending curve, as seen best in FIGS. 7 and 9, arranged to be centered adjacent the upper back portion of a user and a second generally horizontally extending curve, as seen best in FIGS. 8 and 10, arranged to be centered adjacent the lower back portion, the integrally formed back engaging portion being bendable about a horizontal axis located adjacent the center of the first curve and about a vertical axis located adjacent the center of the second curve.

The bendability of the back engaging portion 22 enables the backpack to confirm not only to the configuration of the user's back but also to his movements.

Additionally in accordance with a preferred embodiment of the present invention the integrally formed back engaging portion 22 defines a curved peripheral edge 38 which is joined to fabric defining the remainder of the container.

Reference is now made to FIGS. 3, 4 and 11–15, which illustrate a backpack 40 constructed and operative in accordance with another preferred embodiment of the present invention, and particularly suitable for a school bag for primary school age children. The backpack comprises a container portion 42, typically formed of fabric and which may be of any suitable construction, which is mounted, as by sewing, onto an integrally formed curved back engaging portion 44, in accordance with a preferred embodiment of the present invention.

A body mounting strap assembly 46 supports the container portion 42 and the back engaging portion 44 and preferably comprises a pair of shoulder straps 48, all of which may be of any suitable conventional construction.

The integrally formed curved back engaging portion 44 may be of multilayer construction, as seen particularly in FIG. 5 and described hereinabove, but need not be. In accordance with a preferred embodiment of the invention the back engaging portion 44 is curved as illustrated in FIGS. 11–15. The configuration of back engaging portion 44 defines a first generally vertically extending curve, as seen best in FIGS. 12 and 14, arranged to be centered adjacent the upper back portion of a user, and a second generally horizontally extending curve, as seen best in FIGS. 13 and 15, arranged to be centered adjacent the lower back portion, the integrally formed back engaging portion being bendable about a horizontal axis located adjacent the center of the first curve and about a vertical axis located adjacent the center of the second curve.

The bendability of the back engaging portion 44 enables the backpack to conform not only to the configuration of the user's back but also to his movements.

Additionally in accordance with a preferred embodiment of the present invention the integrally formed back engaging portion 44 defines a peripheral edge 50 which lies in a plane and is joined to fabric defining the remainder of the container. Particular advantage of the apparatus shown and described hereinabove is that the load carried is evenly distributed over the back of the carrier.

Figure 16:
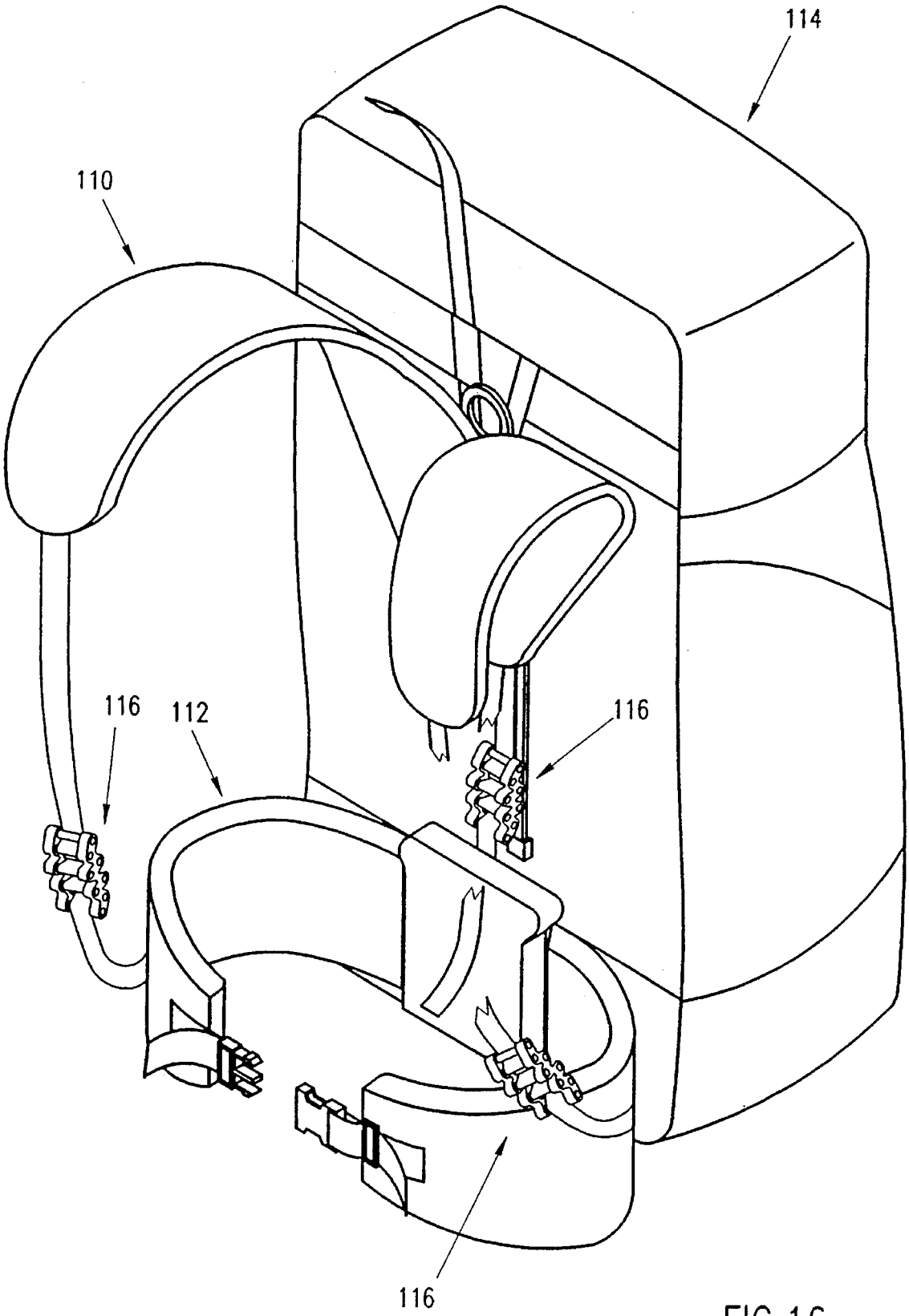
FIG. 16 is a pictorial illustration of a backpack including resilient strap assemblies constructed and operative in accordance with a preferred embodiment of the present invention.
Figure 19:
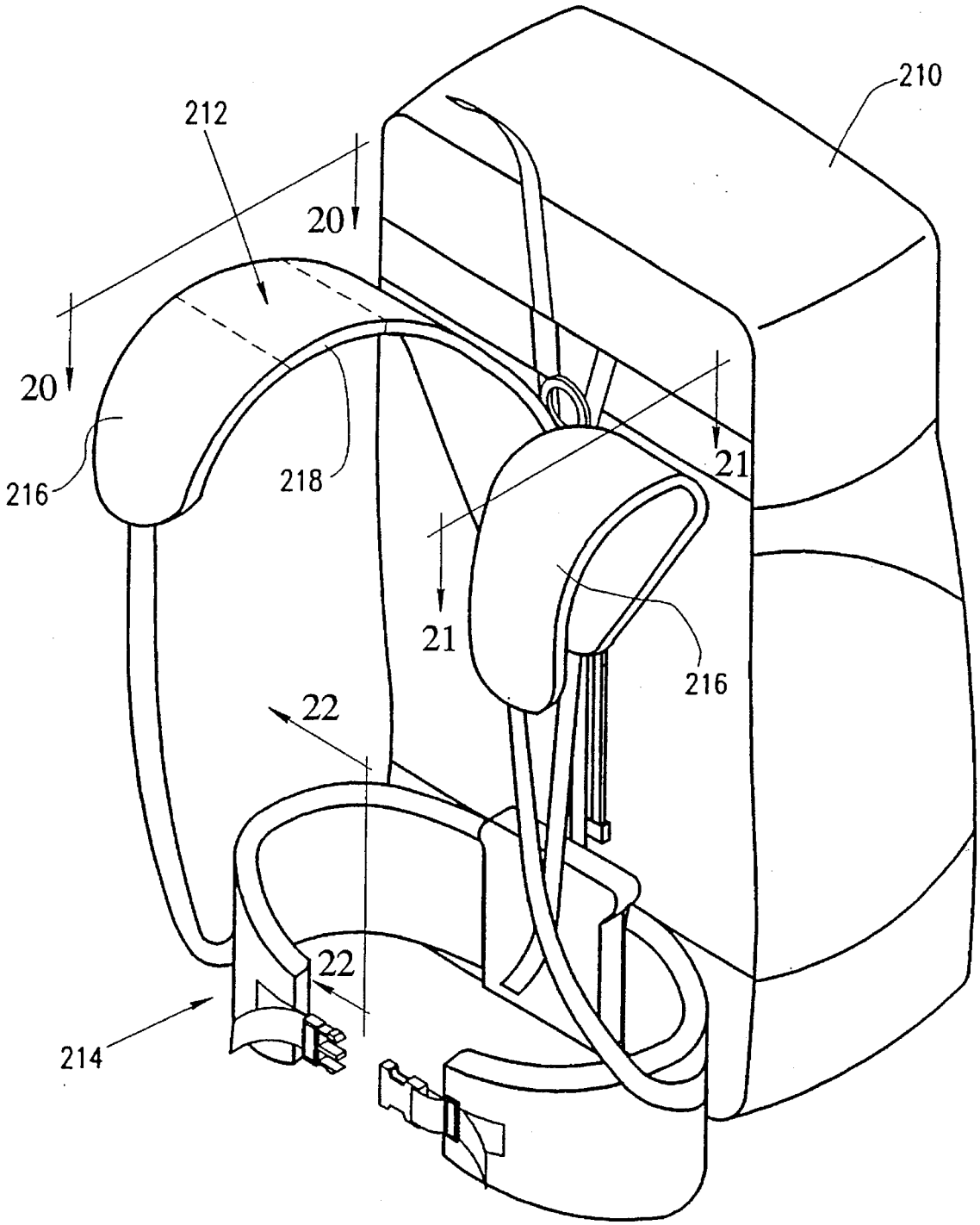
FIG. 19 is a pictorial illustration of a typical backpack constructed and operative in accordance with a preferred embodiment of the present invention.

Reference is now made to FIGS. 16–18B, which illustrate resilient strap assemblies and a backpack incorporating same. As seen in FIG. 16, the backpack comprises a shoulder harness assembly 110 and a hip mounting assembly 112. A backpack load 114 is fixedly mounted onto the hip mounting assembly 112. The shoulder harness assembly 110 is resiliently coupled to the hip mounting assembly 112 and thus to the load 114 via one or more resilient strap assemblies 116. In the illustrated embodiment, two resilient strap assemblies are shown associated with the two shoulder straps respectively, and a third resilient strap assembly is shown associated with the back portion of the backpack. Alternatively, the two shoulder resilient strap assemblies may be eliminated or the third resilient strap assembly may be eliminated.

As seen in FIG. 17, each resilient strap assembly 116 preferably comprises a plurality of rods 118, which may be of any suitable cross section and which may have rollers associated therewith. The rods 118 are preferably normally disposed in at least two planes, indicated by reference numerals 120 and 122 and are mounted at their respective ends on a pair of resilient mounting elements 124 and 126, which are formed of resilient plastic or rubber. A strap 130 is threaded sequentially through the rods 118, as shown in FIGS. 17–18B.

It may be appreciated from a consideration of FIGS. 18A and 18B that mounting elements 124 and 126 are configured and operative such that in the absence of external forces they define a first mutual spacing between rods 118, such as that shown in FIG. 18A, whereby a given length of strap is taken up therein. When tension is applied to the length of strap threaded through the rods 118, as shown in FIG. 18B, this tension deforms the resilient mounting elements 124 and 126, such that the spacing between the rods 118 is changed and effectively decreased, such that the length of strap taken up is effectively decreased.

The structure described hereinabove thus provides a resilient strap assembly which is responsive to the application of tension to the strap, to permit effective elongation thereof against a restoring force exerted by the resilient mounting elements 124 and 126.

A particular advantage of the resilient structure of the present invention is that shocks are absorbed thereby. In other words, jolting movements of the load on the carrier's back are not transferred to the carrier's shoulders. Also, the resilient structure allows additional freedom of movement for the carrier, for example, raising of one shoulder relative to the other shoulder.

It is appreciated that the resilient strap assembly of the present invention may have many possible applications aside from use in backpacks and the like.

Reference is now made to FIGS. 19–22, which illustrate a backpack constructed and operative in accordance with another preferred embodiment of the present invention.

In the embodiment of FIGS. 19–22, the backpack comprises a load carrier 210 which is supported on a shoulder strap assembly 212 and a hip belt assembly 214. In the illustrated embodiment, the shoulder strap assembly 212 includes a pair of shoulder pads 216 which are completely or partially filled with a silicone gel 218, preferably arranged in a pad configuration. The silicone gel may be formed of any suitable formulation. Gelcast silicone gel, commercially available from Chemiprod, of Israel, and employing siliconepolymer, sold by General Electric Company, U.S.A., has provided satisfactory results.

Figure 20:
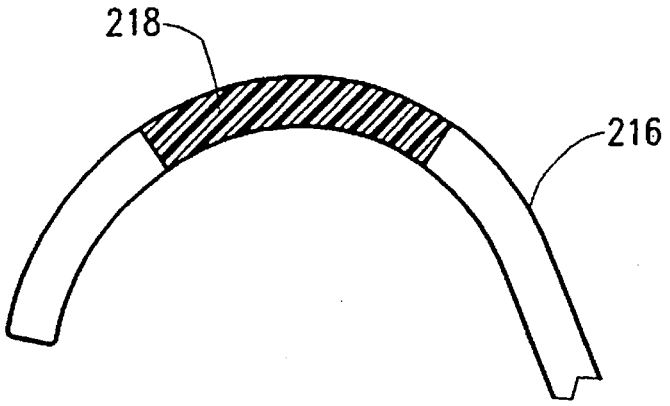
FIGS. 20, 21 and 22 are sectional illustrations of portions of the backpack of FIG. 19, taken along respective section lines XX—XX, XXI—XXI and XXII—XXII.
Figure 21:
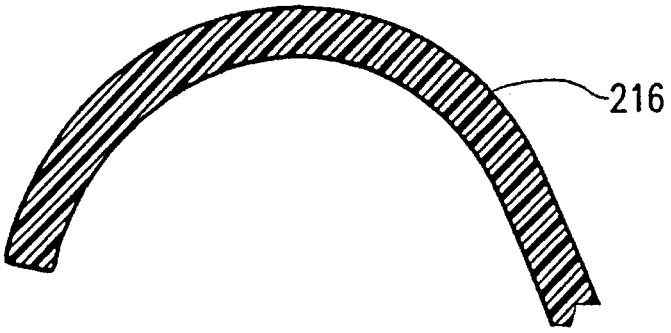

FIG. 20 illustrates one possible arrangement wherein the silicone gel fills only that part of the shoulder pad 216 which normally engages the shoulder. FIG. 21 illustrates an alternative arrangement wherein the silicon gel fills all or most of the shoulder pad 216.

Figure 22:
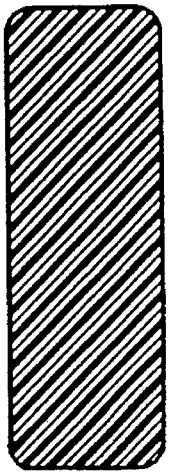

FIG. 22 illustrates silicon gel filling of at least part of the hip belt assembly 214.

The provision of silicone gel in the shoulder pads and/or the hip pads provides a body engaging element which is soft and extremely flexible, while retaining its resilience. Due to its softness and flexibility, the silicone gel can adapt to the uneven surfaces of the carrier's shoulder and hips. These qualities greatly contribute to user comfort in the use of the backpack.

It is appreciated that the use of non-liquid materials having the essential qualities of silicone gel is equally within the scope of the present invention.

It will be appreciated that the present invention is not limited to application to a backpack or to any particular type of backpack, but rather is applicable to any suitable type of load support which is carried on a user's back, i.e. his shoulders and/or hips.

For simplicity and clarity, various features have been separately described herein in the context of separate embodiments. However, these features may, of course, be provided in any suitable combination within a single pack.

It will be appreciated by persons skilled in the art that the present invention is not limited by what has been particularly shown and described hereinabove. Rather the scope of the present invention is defined only by the claims which follow:

We claim:

1. A body engaging load carrier including a load support and at least one of a shoulder strap assembly and a hip engaging belt assembly supporting said load support, wherein at least one of said shoulder strap assembly and said hip engaging belt assembly is at least partially filled with a silicone gel, to conform in a dynamic manner to the shape of a body part engaged thereby in order to increase the size of the effective force bearing region of the body part.

2. Apparatus according to claim 1 and wherein said shoulder strap assembly includes shoulder straps having a shoulder engaging portion which is filled with silicone gel.

3. Apparatus according to claim 2 and wherein the entire shoulder strap is filled with silicone gel.

4. Apparatus according to claim 1 and wherein said hip engaging belt is at least partially filled with silicone gel.

* * * * *